United States Patent [19]

Palmer

[11] Patent Number: 4,802,867

[45] Date of Patent: Feb. 7, 1989

[54] ELECTRICAL CONNECTOR HOUSING ASSEMBLY

[75] Inventor: James W. Palmer, Watford, England

[73] Assignee: AMP Incorporated, Harrisburg, Pa.

[21] Appl. No.: 121,309

[22] Filed: Nov. 16, 1987

[30] Foreign Application Priority Data

Dec. 5, 1986 [GB] United Kingdom ..... 8629112

[51] Int. Cl.[4] ..... H01R 13/40

[52] U.S. Cl. ..... 439/587; 439/279; 439/595

[58] Field of Search ..... 439/587, 589, 592, 595, 439/279

[56] References Cited

U.S. PATENT DOCUMENTS

| | | | |
|---|---|---|---|
| 3,328,745 | 6/1967 | Paullus | 339/61 |
| 3,402,382 | 9/1968 | Detar | 339/103 |
| 3,404,364 | 10/1968 | Paullus et al. | 339/61 |
| 3,573,720 | 4/1971 | Reynolds | 339/217 |
| 4,173,349 | 11/1979 | Neale, III | 439/279 |
| 4,497,531 | 2/1985 | Baker | 339/94 M |
| 4,565,416 | 1/1986 | Rudy et al. | 339/59 M |
| 4,614,390 | 9/1986 | Baker | 339/61 R |
| 4,655,525 | 4/1987 | Hunt, III et al. | 339/63 M |
| 4,711,509 | 12/1987 | Cross et al. | 439/587 |
| 4,721,482 | 1/1988 | Fukuda et al. | 439/595 |
| 4,758,182 | 7/1988 | Anbo et al. | 439/592 |

FOREIGN PATENT DOCUMENTS

| | | |
|---|---|---|
| G8508465.4 | 2/1986 | Fed. Rep. of Germany . |
| 2424642 | 4/1979 | France . |
| 2161996A | 1/1986 | United Kingdom . |
| 8629113 | 8/1987 | United Kingdom . |

*Primary Examiner*—Gil Weidenfeld
*Assistant Examiner*—Paula A. Austin
*Attorney, Agent, or Firm*—Thomas G. Terrell; Bruce J. Wolstoncroft

[57] ABSTRACT

An electrical connector housing (2 or 4) has through terminal receiving cavities (18) opening into a terminal receiving end (16), and mating end, of the housing (2 or 4). The terminal receiving end is surrounded by an axially projecting collar (34) having latching openings (36). A terminal antibackout cap (6) of cellular construction so as to be resiliently compressible has latching projections (66). When terminals have been inserted into the cavities (18), the cap (6) is forced into the collar (34) so that the latching projections (66) engage in the latching openings (36) in the collar (34).

9 Claims, 3 Drawing Sheets

2
4
6
10
12
16
18
34
36
39
40
42
44
54
58
60
62
64
66

ELECTRICAL CONNECTOR HOUSING ASSEMBLY

This invention relates to an electrical connector housing assembly and to an electrical terminal antibackout cap therefor.

There is an increasing demand in the automotive industry for electrical connector housings having means for ensuring that electrical terminals therein cannot back out from terminal receiving cavities in the housings under the action of shock or vibration to which the housings may be subjected when in use. Although terminal antibackout members are known, for example from U.S. Pat. No. 4,565,416, which are slidable through a passage in an electrical connector housing so as to prevent the terminals from backing out of their cavities, by interference with the terminals, problems of sealing the passage against the ingress of moisture can arise, when the housing is to be sealed for example by means of a sealing ring interposed between the housing and a mating housing and bung seals in the terminal receiving cavities of the housing.

According to one aspect of the invention, an electrical connector housing assembly comprises an electrical connector housing having a mating face and a terminal receiving face and defining a plurality of through, terminal receiving cavities each opening into both of said faces, and means projecting from said terminal receiving face and having a latching opening therein, the assembly further comprising a terminal locking cap having latching means thereon for reception in said latching opening and the cap being resiliently compressible to allow said latching means to be inserted into said opening to secure said cap against said terminal receiving face so as to obturate said cavities, the cap having slots therein for receiving electrical leads extending from electrical terminals when such are received in said cavities.

According to another aspect of the invention an electrical connector housing assembly comprises an electrical connector housing having a mating face and a terminal receiving face and defining a plurality of through, terminal receiving cavities each opening into both of said faces, each cavity being formed, intermediate said faces, with means for cooperation with an electrical terminal when such has been inserted into the cavity through said terminal receiving face, to latch the terminal therein, the terminal receiving face of the housing having a collar outstanding therefrom, and the assembly further comprising a secondary locking cap which is resiliently compressible to allow it to be received in said collar so as to obturate each of said cavities at said terminal receiving face, said cap having openings therein for the passage there through of electrical leads extending from the terminals when these are received in said cavities.

According to a further aspect of the invention, an electrical terminal antibackout cap which is of overall circular cross section and is of cellular construction, comprises a plurality of hollow segmental lobes defining slots between them, the slots having arcuate bases which are bowed inwardly of the cap and which connect the lobes, the outer surface of each lobe being formed with a latching projection having a radially outer surface which is inclined axially of the cap, the lobes being resiliently deformable inwardly of said cap.

For a better understanding of the present invention and to show how it may be carried into effect, reference will now be made, by way of example, to the accompanying drawings in which.

Figures 1, 3:
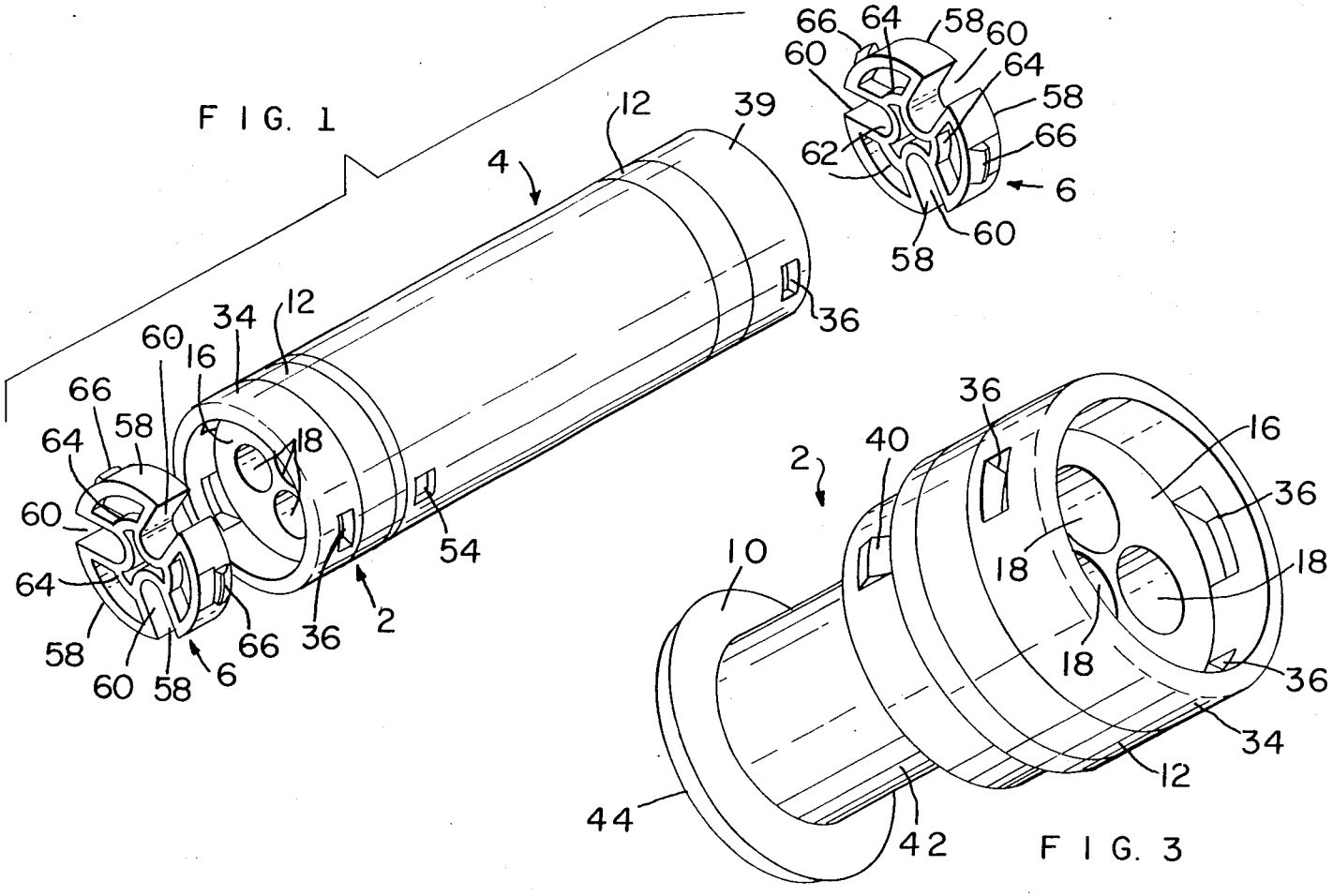
FIG. 1 is an isometric view of an electrical connector housing assembly, showing antibackout caps thereof exploded therefrom.
FIG. 3 is an isometric view of a male housing of the assembly.

The housing assembly comprises a male insulating housing 2, a female insulating housing 4, antibackout caps 6, an annular, circular cross section rolling seal 10, and annular, thin, elastomeric probe seals 12 of elongate cross section.

Each housing 2 and 4, which is of circular cross-sectional shape, has a mating face 14 and a terminal receiving face 16, into each of which open three, circular cross section, through, electrical terminal receiving cavities 18 which extend longitudinally of the housing. Each cavity 18 comprises a seal receiving portion 20, a crimping ferrule receiving portion 22, and a portion 24 for receiving a mating member of an electrical terminal. Between the portions 22 and 24 of each cavity 18 is a terminal latching shoulder 26. Each housings 2 and 4 is formed with three radially extending air vent and test probe access bores 28, each debouching at its inner end into a respective cavity 18 and at its outer end into a probe seal receiving groove 30, extending about the entire outer periphery of the housing, and having an outwardly convex base 32. The face 16 of each housing 2 and 4, is surrounded by an outstanding, peripheral, antibackout cap receiving collar 34 having three peripherally evenly spaced, antibackout cap latch receiving openings 36 extending there through.

The housing 2 has, adjacent to the groove 30, on its side remote from the collar 34, a pair of diametrically opposed latch projections 40, and between the projections 40 and the face 14, a reduced cross section rollway 42 for the rolling seal 10, having at its end nearest to the face 14, that is to say at its leading end, a peripheral flange 44 defining an annular, concave, rolling seal emplacement 46. The housing 2 has, proximate to the projections 40, an annular, seal stop surface 48. The housing 2 is formed with a longitudinal key way 50 opening into the face 14 of the housing 2.

The housing 4 has a hood 52 outstanding from, and surrounding, its face 14 and having opposed latching openings 54 each for receiving one of the projections 40 of the housing 2. There extends normally of the face 14 of the housing 4, a key 56 for reception in the key way 50 of the housing 2.

Figures 2, 7, 8, 10, 11:
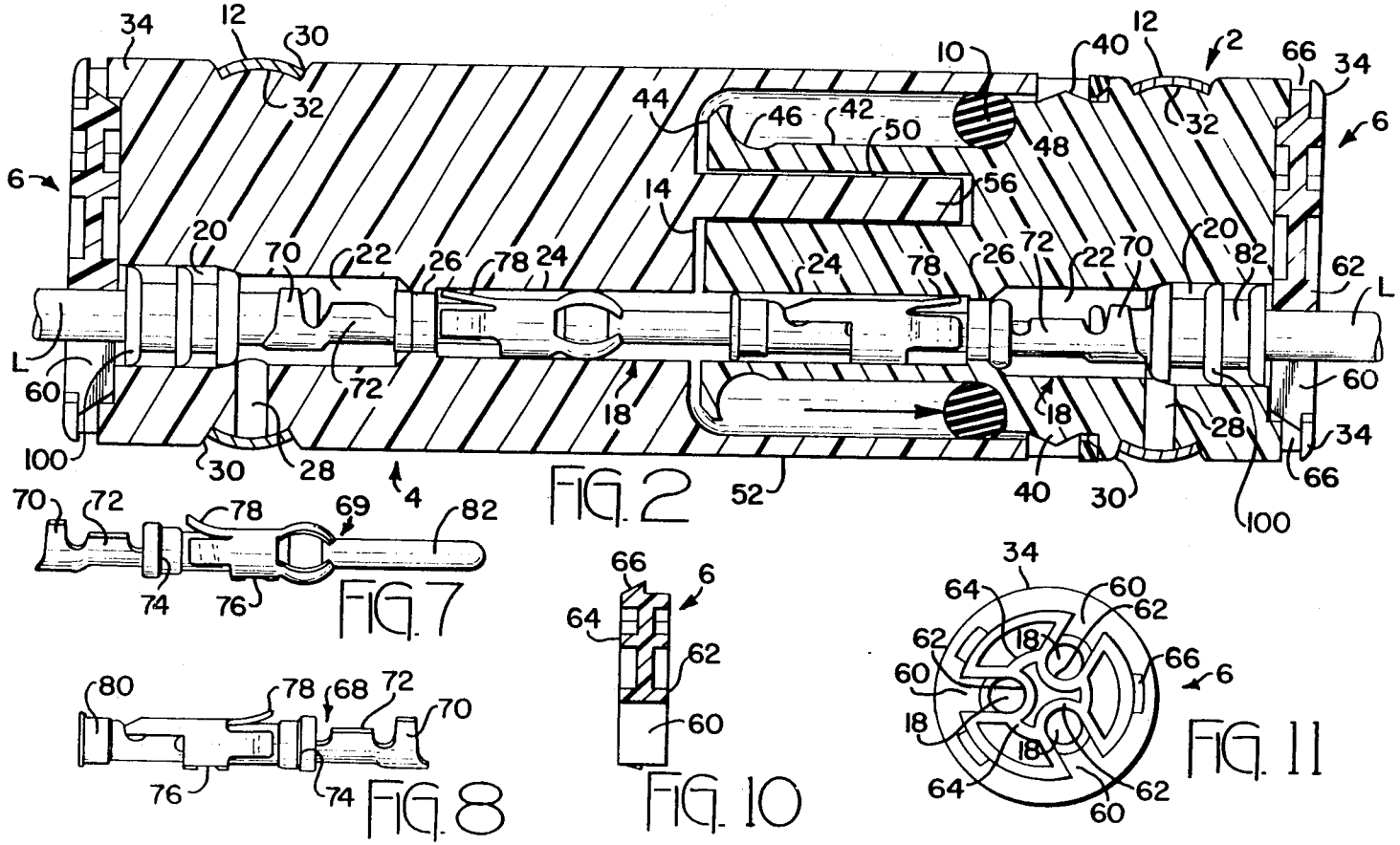
FIG. 2 is an enlarged axial sectional view of the housing assembly showing electrical terminals assembled thereto.
FIG. 7 is a side view of an electrical plug terminal.
FIG. 8 is a side view of an electrical socket terminal.
FIG. 10 is a cross-sectional view of one of said antibackout caps.
FIG. 11 is an end view of said cap when assembled to one of the housings.
Figure 5:
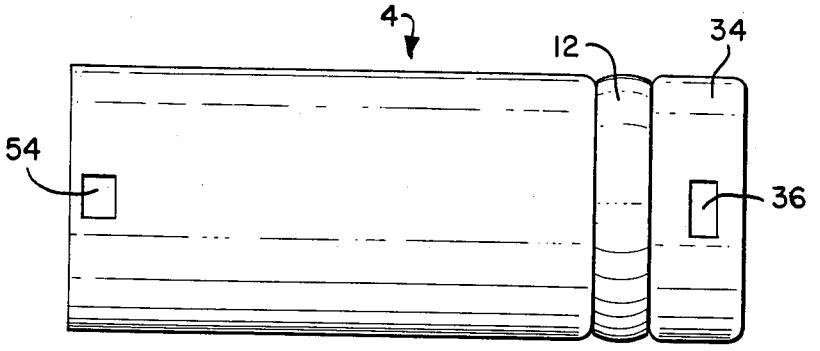
FIG. 5 is a side view of a female housing of the assembly.
Figure 6:
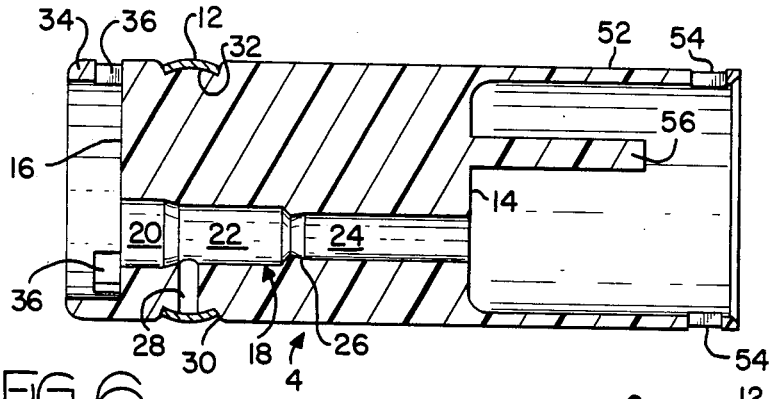
FIG. 6 is an axial sectional view of said female housing.
Figure 4:
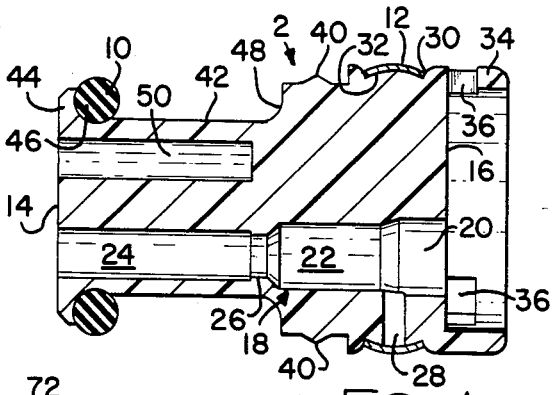
FIG. 4 is an axial sectional view of said male housing.
Figure 9:
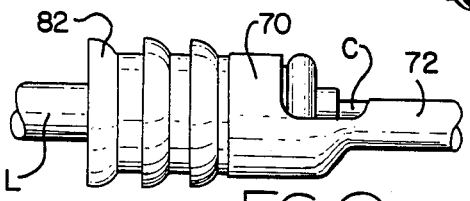
FIG. 9 is a fragmentary side view showing part of a terminal according to FIGS. 7 or 8, when crimped to an elastomeric bung seal and to an electrical lead.

As best seen in FIGS. 1 and 11, each cap 6, which is of overall circular cross section comprises three lobes 58 between which extend substantially U-shaped radial slots 60, each lobe 58 being hollow and being connected to the next adjacent lobes 58 through the arcuate bases 62 of adjacent slots 60, each of which bases 62 is common to two of the lobes 58. The bases 62 are connected together by means of cross struts 64 each common to two of the bases 62 and spanning one of the lobes 58. The caps 6, which are made of insulating material are rendered resilient in a radial direction by virtue of their hollow construction as described above. The arcuate outer periphery of each lobe 58 is formed with a latching projection 66 for latching engagement in a respective opening 36 of a collar 34. The radially outer surface of each projection 66 is formed as an inclined cam surface.

As shown in FIGS. 7 and 8, socket terminals 68, each for reception in a respective cavity 18 of the housing 2, and plug terminals 69 each for reception in a respective cavity 18 of the housing 4, each comprise a crimping portion consisting of a U-section insulation barrel 70 and a U-section wire barrel 72; a transition portion 74; and a latching portion 76 provided with a resilient latching tongue 78. The terminals 68 have sockets 80 for mating with plugs 82 of the terminals 69.

Before assembling the terminals 68 and 69 to their respective housings 2 and 4, the wire barrel 72 of each terminal is crimped to the electrically conductive core C of an insulated electrical lead L and the insulation barrel of the terminal is crimped about an elastomeric grommet, in the form of a bung seal 100, previously threaded onto the lead L.

Each terminal is inserted into its cavity 18 so that, as shown in FIG. 2, the seal 100 is in sealing engagement with the wall of the cavity portion 20, the crimped barrels 70 and 72 are located in the cavity portion 22 and the socket 80 or the plug 82, as the case may be, in the cavity portion 24. In this position of the terminal, the latching tongue 78, which was depressed by the shoulder 26 in the cavity 18, during the insertion of the terminal there into, has resiled so as to latch behind the shoulder 26.

Each antibackout cap 6 is now assembled to the three leads L projecting from the respective housing 2 or 4, so that each of the three leads L is received in a respective slot 60 of the cap 6. The cap 6 is then pushed home into the respective collar 34 so that each of the projections 66 of the cap 6 snaps into a respective opening 36 of the collar 34 so that the cap 6 is positively retained therein, the bases 62 of the slots 6, which obturate the cavities 18, being in interference with the seals 100 so as to prevent the terminals from backing out from the cavities 18, regardless of the efficiency of the latching engagement between the latching tongues 78 and the shoulders 26.

The resilient, cellular construction of the caps 6 in the form of segmental hollow lobes allows the lobes 58 thereof to be resiliently deformed inwardly, to enable the projections 66 to be received in the collars 34, the lobes 58 resiling outwardly as the projections 66 enter the openings 36. The radial compression of, and thus the insertion of, the caps 6 into the collars 34 is assisted by the fact that the radially outer surfaces of the projections 66 slope outwardly and away from the collars 34.

Prior to the housings 2 and 4, now loaded with terminals 68 and 69, respectively, being mated, the rolling seal 10 is located in the emplacement 46 of the housing 2 and the bores 28 are covered by the probe seals 12. As the housings 2 and 4 are being mated, the rollway 42 of the housing 2 enters the hood 52 of housing 4, the key 56 thereof entering the key way 50 of the housing 2, until the housings 2 and 4 are in fully mated relationship as shown in FIG. 2 with the plugs 82 of the terminals 69 fully received in the sockets 80 of the terminals 68. As the housings 2 and 4 are being mated, the rolling seal 10 engages the inner wall of the hood 52 and is thereby rolled from the emplacement 46, along the rollway 42, until it engages against the stop surface 48 of the housing 2, as the projections 40 on that housing snap into the openings 54 in the hood 52 of the housing 4. As the rolling seal 10 rolls over it creates a "pull home" force urging the housings 2 and 4 towards their mating relationship. The seal 10 could be of square cross section and arranged to engage against the stop surface 48 with a snap action according to the teaching of GB-A-2161996 which is incorporated herein by reference.

Since the cavities 18 are sealed by the bung seals 100 and the rolling seal 10 acts as a seal between the housings 2 and 4 as they are being mated, air is compressed between the housings during the mating operation, so as to tend to oppose their mating. However, the probe seals 12 are sufficiently flexible to be raised by the air so compressed, so as to act as their escape valves so that the mating operation is not sensibly impeded by the compression of the air between the housings 2 and 4.

Electrical continuity between the lead cores C and the terminals, and/or between the terminals 68 and 69 can be tested for, by lifting the seals 12 manually and inserting a test probe (not shown) into each bore 28, in turn.

The seals 12 normally hug the arcuate bases 32 so as to seal the bores 28 against the ingress of moisture when the housing assembly is in use, for example, in the engine compartment of an automobile.

I claim:

1. An electrical connector housing assembly comprising an electrical connector housing having a mating face and a terminal receiving face and defining a plurality of through, terminal receiving cavities each opening into both of said faces, and means projecting from said terminal receiving face and having a latching opening therein, the assembly further comprising a terminal locking cap having latching means thereon for reception in a latching opening provided in means projecting from said terminal receiving face, the cap being resiliently compressible to allow said latching means to be inserted into said opening to secure said cap against said terminal receiving face so as to obturate said cavities, the cap having a plurality of hollow lobes spaced from each other to receive electrical leads extending from electrical terminals between them.

2. An assembly as claimed in claim 1, in which the cap is of overall circular cross-sectional shape and comprises a plurality of hollow segment shaped lobes therein which are spaced from each other to receive the leads between them.

3. An electrical connector housing assembly comprising an electrical connector housing having a mating face and a terminal receiving face and defining a plurality of through, terminal receiving cavities each opening into both of said faces, each cavity being formed, intermediate said faces, with means for cooperation with an electrical terminal when such has been inserted into the cavity through said terminal receiving face, to latch the terminal therein, the terminal receiving face of the housing having a collar outstanding therefrom, and the assembly further comprising a secondary locking cap which is resiliently compressible to allow it to be received in said collar so as to obturate each of said cavities at said terminal receiving face, said cap having openings therein for the passage therethrough of electrical leads extending from the terminals when these are received in said cavities said cap having a plurality of hollow lobes spaced from each other to receive said leads between them.

4. An assembly as claimed in claim 3, in which the radially outer surface of each lobe has a latching projection outstanding therefrom and having a radially outer surface which is inclined in the axial direction of the cap.

5. An assembly as claimed in claim 3, in which the collar is formed with latching openings, the cap having latching projections for reception in the latching openings, the latching projections having cam surfaces thereon to assist the compression of the collar, as the cap is inserted thereinto.

6. An assembly as claimed in claim 3, in which the cap is of overall circular cross section, each lobe being in the form of a segment.

7. An assembly as claimed in claim 6, in which each lobe is connected to the next adjacent lobe through an arcuate base of a recess defined between these lobes, said bases being connected by struts spanning the lobes.

8. An electrical terminal antibackout cap which is of overall circular cross section and is of cellular construction and thereby comprises a plurality of hollow segmental lobes defining slots between them, the slots having arcuate bases which are bowed inwardly of the cap and which connect the lobes, the outer surface of each lobe being formed with a latching projection having a radially outer surface which is inclined axially of the cap, the lobes being resiliently deformable radially inwardly of the antibackout cap.

9. A cap as claimed in claim 8, in which said bases are connected by struts which span the lobes.

* * * * *